United States Patent [19]

Klotz et al.

[11] 4,043,144

[45] Aug. 23, 1977

[54] HOT GAS DEFROST SYSTEM

[75] Inventors: Michael C. Klotz, Chicago; Viung C. Mei, Mount Prospect, both of Ill.

[73] Assignee: Dole Refrigerating Company, Chicago, Ill.

[21] Appl. No.: 696,886

[22] Filed: June 17, 1976

[51] Int. Cl.[2] ..... F25B 47/00; F25B 41/00; F25D 11/04

[52] U.S. Cl. ..... 62/277; 62/196 B; 62/438

[58] Field of Search ..... 62/277, 196 B, 438, 62/81

[56] References Cited

U.S. PATENT DOCUMENTS

| | | | |
|---|---|---|---|
| 3,015,939 | 1/1962 | Brainard | 62/196 B |
| 3,845,638 | 11/1974 | Apple, Jr. et al. | 62/419 |

*Primary Examiner*—Lloyd L. King
*Attorney, Agent, or Firm*—Kinzer, Plyer, Dorn & McEachran

[57] ABSTRACT

A vehicle eutectic plate refrigeration system provides simultaneous defrosting of part of the plate exterior surface, all of the secondary heat transfer surface and freezing of the eutectic solution within the plate. This system thus preserves sufficient space for air passage, which otherwise would be blocked by frost and ice. The system utilizes the normally rejected heat to perform a defrosting function and utilizes the ice and frost to perform the refrigerant condensing function. Hot gas from the compressor is diverted through the defrost coil where the refrigerant is for the most part condensed before it is passed through the condenser. The liquid refrigerant from the condenser is then used to freeze the eutectic solution within the plate. After completion of the defrost operation, determined by sensing refrigerant temperature at the outlet of the defrost coil, or by some other means, all of the compressor refrigerant discharge is directed through the condenser to continue freezing of the eutectic solution.

7 Claims, 1 Drawing Figure

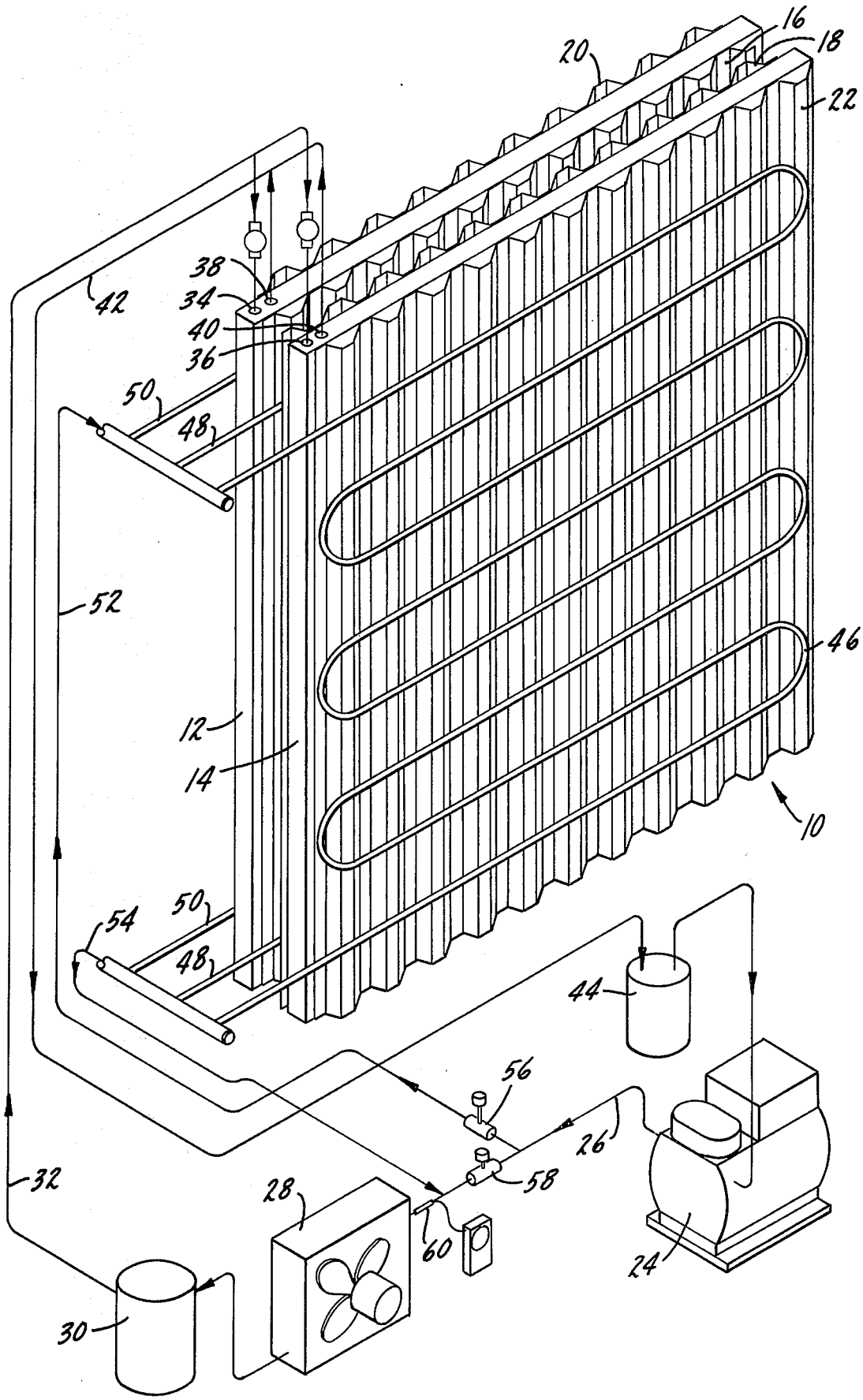
16
18
20
22
38
34
40
36
42
50
48
52
46
12
14
10
54
50
48
44
56
26
58
32
28
60
24
30

HOT GAS DEFROST SYSTEM

SUMMARY OF THE INVENTION

The present invention relates to refrigeration systems and particularly to a vehicle eutectic plate refrigeration system in which hot gas from the compressor is used to defrost the cooling surfaces.

One purpose of the invention is a vehicle eutectic plate system of the type described in which the eutectic is frozen simultaneously with the defrosting operation.

Another purpose is a defrosting arrangement of the type described in which the defrosting coil is also a condensing coil.

Another purpose is an eutectic plate refrigeration system in which the refrigerant is used both as a defrosting medium and as a freezing medium.

Another purpose is a method of simultaneously defrosting an eutectic plate system while freezing the eutectic in the plate.

Another purpose is a simply constructed reliably operable automatic method of defrosting an eutectic plate refrigeration system.

Another purpose is a defrost system which eliminates city water consumption and reduces electric power consumption.

Other purposes will appear in the ensuing specification, drawing and claims.

BRIEF DESCRIPTION OF THE DRAWING

The invention is illustrated diagrammatically in the attached schematic showing the preferred form of the invention.

DESCRIPTION OF THE PREFERRED EMBODIMENT

The present invention relates to a means for defrosting eutectic plates of the type shown in U.S. Pat. No. 3,845,638. Specifically, defrost coils are positioned in contact with plate exterior secondary heat transfer surfaces. Hot gas from the compressor derived during freezing of the eutectic is diverted through the defrost coil where the gas is for the most part condensed and then returned to the condenser. The condenser completes the liquefication process and directs the liquid refrigerant to the eutectic plates to freeze the solution within the plates.

In the drawing, the eutectic plate assembly is indicated generally at 10 and will conventionally be enclosed within a cover. The plate assembly includes spaced eutectic plates 12 and 14, which are identical in construction. Sheets of corrugated material, preferably aluminum, are positioned on each side of each plate. The interior sheets are designated at 16 and 18 and are positioned directly against the interior sides of plates 12 and 14. Exterior corrugated sheets 20 and 22 are positioned on the outside of plates 12 and 14. Details of the plates assembly are shown in the above-mentioned patent.

The eutectic plates are conventionally used in an over-the-road vehicle, for example a milk or meat truck. The plates are frozen during the non-operative periods of the vehicle by the use of a condensing unit. During the period that the vehicle is running on-the-route, although the condensing unit may be physically upon the vehicle, it does not operate to freeze the eutectic within the plates. Normally the plates will remain partially frozen during the period of vehicle operation and they are then completely refrozen when the vehicle is at the dock for nighttime loading.

The refrigeration system includes a conventional compressor 24 connected by a hot gas line 26 to a condenser 38. The output from the condenser passes through a liquid receiver 30 and then through liquid line 32 to parallel connected thermal expansion valves, thence to inlets 34 and 36, respectively, of plates 12 and 14. In this connection it should be understood that each of the plates will have refrigeration coils passing through them, although the coils are not shown in detail.

Each of the plates has refrigerant outlets or discharge ports 38 and 40 which are connected to a conduit 42 which in turn is connected to an accumulator 44. The output from the accumulator is connected to compressor 24.

A defrost coil is indicated at 46 and passes in a serpentine manner across and is in intimate contact with the exposed surface of corrugated sheet 22. There are three such coils, coil 48 being positioned between corrugated sheets 16 and 18 and coil 50 being positioned on the outside of sheet 20. Defrost coils 46, 48 and 50 are connected in parallel to an inlet conduit 52 and an outlet conduit 54. The defrost coils may conventionally be formed of copper, aluminum or steel and will be positioned directly in contact with the aluminum corrugated sheets. Inlet conduit 52 is connected through a solenoid controlled valve 56 to the compressor side of hot gas line 26. Outlet conduit 54 is connected to the condenser side of hot gas line 26. A solenoid controlled valve 58 is connected between the points of connection of conduits 52 and 54 with hot gas line 26. It should be understood that one three-way solenoid operated valve could be used in place of the two individual solenoid operated valves. The structure is completed by a thermostat, indicated diagrammatically at 60, which is connected between condenser 28 and the connection between discharge conduit 54 and hot gas line 26. Thermostat 60 will control operation of valves 56 and 58, as described hereinafter.

In the normal use of the eutectic plates, they are frozen before the vehicle goes upon the rod. Air will be blown across the plates, in the manner described in the above-mentioned patent, to cool the inside of the vehicle. The fan and air passages have not been described herein. During the course of the day most of the frozen eutectic solution will be melted and the surface of the plate and the aluminum corrugated sheets will be covered with snow and ice due to moisture in the air. When the vehicle arrives at the dock at night the condensing unit is operated to refreeze the eutectic solution. Normally, valve 56 will be open and valve 58 will be closed. Thus, hot gas from compressor 24 will flow through conduit 52 to defrost coils 46, 48 and 50. The hot gas, as it passes through the coils which are in contact with the corrugated aluminum sheets, will defrost part of the surfaces of the plates and all surfaces of the corrugated sheets. The heat transfer between the coils and the sheets is mainly by conduction which is much more efficient than heat transfer by convection and/or radiation. The refrigerant in the defrost coils, when it reaches discharge conduit 54, will be for the most part condensed due to the defrosting operation. This partially condensed refrigerant will pass through conduit 54, flow past thermostat 60 and then to condenser 28. Condenser 28 will liquefy any remaining gaseous refrigerant in the conventional manner and supply such refrigerant through conduit 32 to the thermal expansion valves where the refrigerant experiences the pressure drop which provides the freezing effect in the plates. The eutectic will be frozen in the normal manner due to passage of the cold refrigerant through the coils within plates 12 and 14. The process will continue, that is, the simultaneous defrosting of the plate exteriors and freezing of the plate interiors, until such time as the refrigerant passing through discharge conduit 54 is above a predetermined temperature level. At this point thermostat 60 will reverse the positions of valves 56 and 58 so that hot gas from compressor 24 will be directed to condenser 28 and will not be diverted or bypassed through the defrost coil.

There are a number of advantages to the present defrost system over conventional water defrost systems. First, there is no water consumed in the defrosting process and thus no waste water to disposed of. Second, the defrost system itself requires no electrical power and in fact itself substantially increases the coefficient of performance of the overall refrigeration system as the normally rejected heat which is used to melt the ice and snow uses the undesired ice and snow to condense the hot gas. Thus, the coefficient of performance may be more than doubled during the defrosting portion of the refreezing operation. There is a substantial power saving in that during the defrost cycle the lower pressure of the returning subcooled liquid will not turn on the condenser fan. Also, the compressor runs at a lower pressure differential, thus drawing less electrical current.

Because the condenser fan motor will not be running, and because the compressor operates easier on lower pressure differential, the condenser fan motor and compressor will have longer life.

The defrost system has no moving parts, only two solenoid valves which require little maintenance. The defrosting coils will not wear out and the entire defrosting operation is fully automatic, both in initiation and termination.

In prior defrosting systems, particularly a water defrost system, as much as 50 gallons of water per day per truck were necessary to provide a frost-free plate. The present invention entirely eliminates the use of water.

Whereas the preferred form of the invention has been shown and described herein, it should be realized that there may be many modifications, substitutions and alterations thereto.

The embodiments of the invention in which an exclusive property or privilege is claimed are defined as follows:

1. In an eutectic plate refrigeration system, an eutectic plate, refrigerant conduit means within said plate and having an inlet and a discharge, a compressor connected to said discharge and a condenser connected to said inlet, a hot gas line connecting said compressor and condenser, a defrost coil positioned exterior to said plate and having an inlet and a discharge connected, respectively, to the compressor and condenser sides of said hot gas line, valve means connected between said defrost coil inlet and the compressor side of said hot gas line, valve means connected in said hot gas line between the defrost coil inlet and discharge connections thereto, in one position of said valve means refrigerant from said compressor passing successively through said defrost coil, through said condenser, through said plate refrigerant conduit means and back to said compressor.

2. The refrigeration system of claim 1 further characterized by and including a thermostat connected in said hot gas line between the defrost coil discharge connection thereto and said condenser, said thermostat controlling operation of said valve means.

3. The system of claim 1 further characterized in that said valve means connected between said defrost coil inlet and the compressor side of said hot gas line is normally open and said valve means connected in said hot gas line is normally closed.

4. The system of claim 1 further characterized by and including a plurality of defrost coils positioned exterior to said plate, each having an inlet and a discharge, said defrost coils being connected in parallel to the compressor and condenser sides of said hot gas line.

5. The system of claim 4 further characterized by and including heat transfer surfaces mounted on the exterior of said eutectic plate and position between said eutectic plate and said defrost coils, said defrost coils being in contact with the exterior of said heat transfer surfaces.

6. The system of claim 1 further characterized by and including a plurality of eutectic plates arranged side by side, a defrost coil positioned between said plates and defrost coils positioned on the opposite sides of said plates, said defrost coils being connected in parallel to said compressor and condenser sides of said hot gas line.

7. The system of claim 1 further characterized in that in a second position of said valve means refrigerant from said compressor passes successively through said condenser, through said plate refrigeration conduit means and back to said compressor.

* * * * *